US007965967B2

(12) United States Patent
Murayama

(10) Patent No.: US 7,965,967 B2
(45) Date of Patent: Jun. 21, 2011

(54) IMAGE-FORMING DEVICE WITH CALIBRATION CAPABILITIES

(75) Inventor: Kentaro Murayama, Kasugai (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 325 days.

(21) Appl. No.: 12/043,537

(22) Filed: Mar. 6, 2008

(65) Prior Publication Data

US 2008/0226359 A1 Sep. 18, 2008

(30) Foreign Application Priority Data

Mar. 14, 2007 (JP) ..... 2007-065101

(51) Int. Cl.
*G03G 15/01* (2006.01)

(52) U.S. Cl. ..... 399/301; 399/49

(58) Field of Classification Search ..... 399/301, 399/49; 347/116

See application file for complete search history.

(56) References Cited

U.S. PATENT DOCUMENTS

| | | | | |
|---|---|---|---|---|
| 6,008,826 | A | 12/1999 | Foote et al. | |
| 7,830,403 | B2 | 11/2010 | Murayama | |
| 2003/0214568 | A1* | 11/2003 | Nishikawa et al. | 347/116 |
| 2007/0071510 | A1* | 3/2007 | Matsuyama et al. | 399/301 |
| 2008/0225307 | A1 | 9/2008 | Murayama et al. | |
| 2008/0292370 | A1* | 11/2008 | Murayama | 399/301 |
| 2009/0162110 | A1* | 6/2009 | Murayama | 399/301 |
| 2009/0162111 | A1* | 6/2009 | Murayama | 399/301 |
| 2009/0162112 | A1* | 6/2009 | Murayama | 399/301 |

FOREIGN PATENT DOCUMENTS

| | | |
|---|---|---|
| JP | 11-038719 | 2/1999 |
| JP | 11-327249 | 11/1999 |
| JP | 2008-224858 | 9/2008 |
| JP | 2008-225192 | 9/2008 |

* cited by examiner

*Primary Examiner* — David M Gray
*Assistant Examiner* — G. M. Hyder
(74) *Attorney, Agent, or Firm* — Banner & Witcoff, Ltd.

(57) ABSTRACT

The pattern data generating unit generates pattern data indicative of a pattern of a plurality of marks including a plurality of first marks each having a first color and a plurality of second marks each having a second color so that a first target-total is equal to a second target-total. The first target-total is a total of deviations of first target-positions from a reference position in a predetermined direction. The second target-total is a total of deviations of second target-positions from the reference position in the predetermined direction. The controlling unit controls the image-forming unit to calibrate the second target-positions based on the offset of a second actual-total from a first actual-total.

12 Claims, 10 Drawing Sheets

IMAGE-FORMING DEVICE WITH CALIBRATION CAPABILITIES

CROSS REFERENCE TO RELATED APPLICATION

This application claims priority from Japanese Patent Application No. 2007-065101 filed Mar. 14, 2007. The entire content of each of these priority applications is incorporated herein by reference.

TECHNICAL FIELD

The present invention relates to an image-forming device.

BACKGROUND

Tandem image-forming devices are well known in the art. This type of image-forming device is typically provided with a photosensitive member for each of the colors yellow, magenta, cyan, and black, for example. The photosensitive members are juxtaposed along the circulating direction of a paper-conveying belt. Color images carried on the photosensitive members are thus transferred onto paper conveyed on the belt.

However, if the positions at which the color images are formed on the paper deviate from each other in this tandem image-forming device, the resulting color image is not registered properly. Hence, aligning the formation positions of the color images is vital.

To this end, Japanese unexamined patent application publication No. HEI-11-327249 discloses an image-forming device for detecting offset in the formation positions of the color images and for calibrating these positions. More specifically, this image-forming device forms a registration pattern configured of yellow, magenta, cyan, and black patterns on the conveying belt, each color pattern including a plurality of marks arranged along the conveying direction of the belt. The positions of marks constituting the color patterns formed on the belt vary according to positional offset of the corresponding colored images. Therefore, the image-forming device sets one of the colors yellow, magenta, cyan, or black as a reference color, measures distances between marks in the pattern of the reference color and the patterns of the other colors based on detection signals outputted from photosensors detecting the positions of the marks, and determines whether these distances match predetermined values. If the distances do not match, then the image-forming device determines that the color images are out of registration and performs calibration to correct this registration error.

SUMMARY

However, the image-forming device according to Japanese unexamined patent application publication No. HEI-11-327249 must perform at least the following steps (1) through (4) in order to detect positional offset of the color images.

(1) Acquire positional data for the set of marks constituting each color pattern.

(2) Calculate a center position in the set of marks for each color from the positional data for the set of marks.

(3) Calculate positional deviation between the pattern of the reference color and the patterns of the other colors using the center position as the position of the color pattern corresponding to the set of marks in each color.

(4) Calculate positional offset for each-color image based on the positional deviation and a predetermined value.

Hence, error introduced in the above four steps can affect precision in detecting positional offset for each color image.

In view of the above-described drawbacks, it is an objective of the present invention to provide an image-forming device capable of detecting the positional offset of each color image in a process with simplified steps. In order to attain the above and other objects, the present invention provides an image-forming device including a pattern data generating unit, an image-forming unit, a detecting unit, a calculating unit, and a controlling unit. The pattern data generating unit generates pattern data indicative of a pattern of a plurality of marks including a plurality of first marks each having a first color and a plurality of second marks each having a second color so that a first target-total is equal to a second target-total. The first target-total is a total of deviations of first target-positions on an object at which the plurality of first marks is formed from a reference position in a predetermined direction. The second target-total is a total of deviations of second target-positions on the object at which the plurality of second marks is formed from the reference position in the predetermined direction. The image-forming unit forms color images on the object based on the pattern data. The detecting unit detects first actual-positions on the object at which the plurality of first marks has been formed in the predetermined direction, and detects second actual-positions on the object at which the plurality of second marks has been formed in the predetermined direction. The calculating unit calculates an offset of a second actual-total from a first actual-total based on the first actual-positions and the second actual-positions detected by the detecting unit. The first actual-total is a total of deviations of the first actual-positions from the reference position. The second actual-total is a total of deviations of the second actual-positions from the reference position. The controlling unit controls the image-forming unit to calibrate the second target-positions based on the offset.

BRIEF DESCRIPTION OF THE DRAWINGS

The particular features and advantages of the invention as well as other objects will become apparent from the following description taken in connection with the accompanying drawings, in which.

DETAILED DESCRIPTION

First Embodiment

A first embodiment of the present invention will be described with reference to FIGS. 1 through 7.

<Overall Structure of the Printer>

Figure 1:
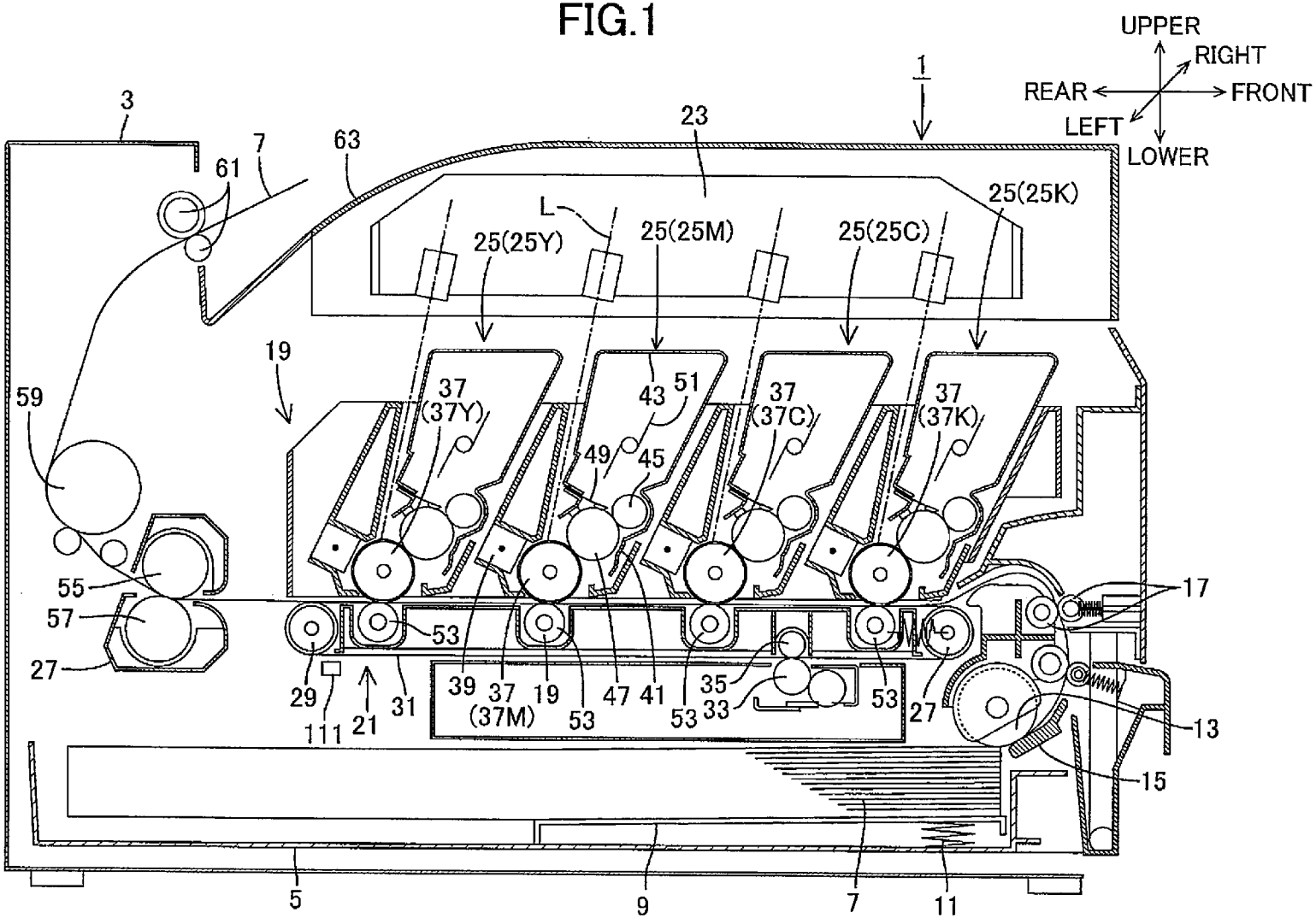
FIG. 1 is a cross-sectional view showing the overall structure of a printer according to a first embodiment of the present invention.

FIG. 1 is a side cross-sectional view showing the overall structure of a printer 1 according to the preferred embodiment. In the following description, the right side of the printer 1 (or right direction) in FIG. 1 will be referred to as the front side (or forward direction).

As shown in FIG. 1, the printer 1 is a direct transfer tandem-type color laser printer. The printer 1 includes a casing 3, and a paper tray 5 provided in the bottom of the casing 3 for holding a paper or other sheet-like recording medium 7 in a stacked state.

The printer 1 also includes a pressing plate 9 disposed in the paper tray 5 beneath the recording medium 7, a pickup roller 13 positioned above the front edge of the recording medium 7, a pair of registration rollers 17 disposed downstream of the pickup roller 13 with respect to a conveying direction, and a belt unit 21 disposed downstream of the registration rollers 17 in the conveying direction. The pressing plate 9 functions to press the recording medium 7 toward the pickup roller 13. The rotating pickup roller 13 picks up and conveys sheets of the recording medium 7 to the registration rollers 17. The registration rollers 17 correct skew in the sheets of recording medium 7 and convey the sheets onto the belt unit 21 at a prescribed timing.

The belt unit 21 includes a pair of support rollers 27 and 29, and an endless belt 31 looped around the support rollers 27 and 29. The driving rotation of the support roller 29 on the rear side, for example, moves the endless belt 31 circularly in the clockwise direction of FIG. 1 so that a sheet of recording medium 7 placed on top of the endless belt 31 is conveyed rearward.

A cleaning roller 33 is disposed on the underside of the belt unit 21 for removing toner (including a registration pattern 121" or "marks 119" described later), paper dust, and the like deposited on the endless belt 31.

The printer 1 also includes an image-forming unit 19 disposed above the belt unit 21, a scanning unit 23, and a fixing unit 27. The image-forming unit 19 includes process units 25.

The scanning unit 23 is disposed above the image-forming unit 19 and includes a laser light-emitting element (not shown) controlled to turn on and off based on image data. The laser light-emitting elements are provided for each color and irradiate laser beams L that are scanned at a high speed over the surfaces of photosensitive drums 37 provided in the image-forming unit 19 for each color.

The image-forming unit 19 has four of the process units 25 corresponding to the colors black, cyan, magenta, and yellow. Each of the process units 25 has the same construction, excluding the color of toner and the like. In the following description, the letters K (black), C (cyan), M (magenta), and Y (yellow) are appended to part numbers when it is necessary to distinguish between each color, but are excluding when such distinction is unnecessary.

Each process unit 25 includes the photosensitive drum 37, a charger 39, and a developer cartridge 41.

Each developer cartridge 41 includes a toner-accommodating chamber 43, a supply roller 45, a developing roller 47, a thickness-regulating blade 49, and an agitator 51 disposed in the toner-accommodating chamber 43.

Toner is supplied onto the developing roller 47 by the rotation of the agitator 51 and supply roller 45. The toner carried on the surface of the developing roller 47 is regulated to a thin layer of uniform thickness by the thickness-regulating blade 49 as the toner passes between the thickness-regulating blade 49 and developing roller 47.

The charger 39 charges the surface of the photosensitive drum 37 with a uniform positive polarity. Subsequently, the scanning unit 23 irradiates a laser beam onto the surface of the photosensitive drum 37 to form an electrostatic latent image corresponding to a color image to be formed on the recording medium 7.

The toner carried on the developing roller 47 is subsequently supplied to the electrostatic latent image formed on the surface of the photosensitive drum 37. Accordingly, the electrostatic latent image on the photosensitive drum 37 is developed into a visible toner image for the corresponding color.

As a sheet of recording medium 7 conveyed on the endless belt 31 passes through a transfer position between the photosensitive drum 37 and a corresponding transfer roller 53, the toner image carried on the surface of the photosensitive drum 37 is transferred onto the recording medium 7 by a negative transfer bias applied to the transfer roller 53. In this way, toner images in each color are sequentially transferred onto the recording medium 7 as the recording medium 7 is conveyed to the fixing unit 27.

The fixing unit 27 includes a heating roller 55 and a pressure roller 57 for conveying the recording medium 7 while applying heat to the same. The heat applied to the recording medium 7 fixes the transferred toner images to the recording medium 7. After the images have been fixed in the fixing unit 27, the recording medium 7 is conveyed by a conveying roller 59 to discharge rollers 61. The discharge rollers 61 discharge the recording medium 7 onto a discharge tray 63 formed on top of the casing 3.

<Electrical Structure of the Printer>

Figure 2:
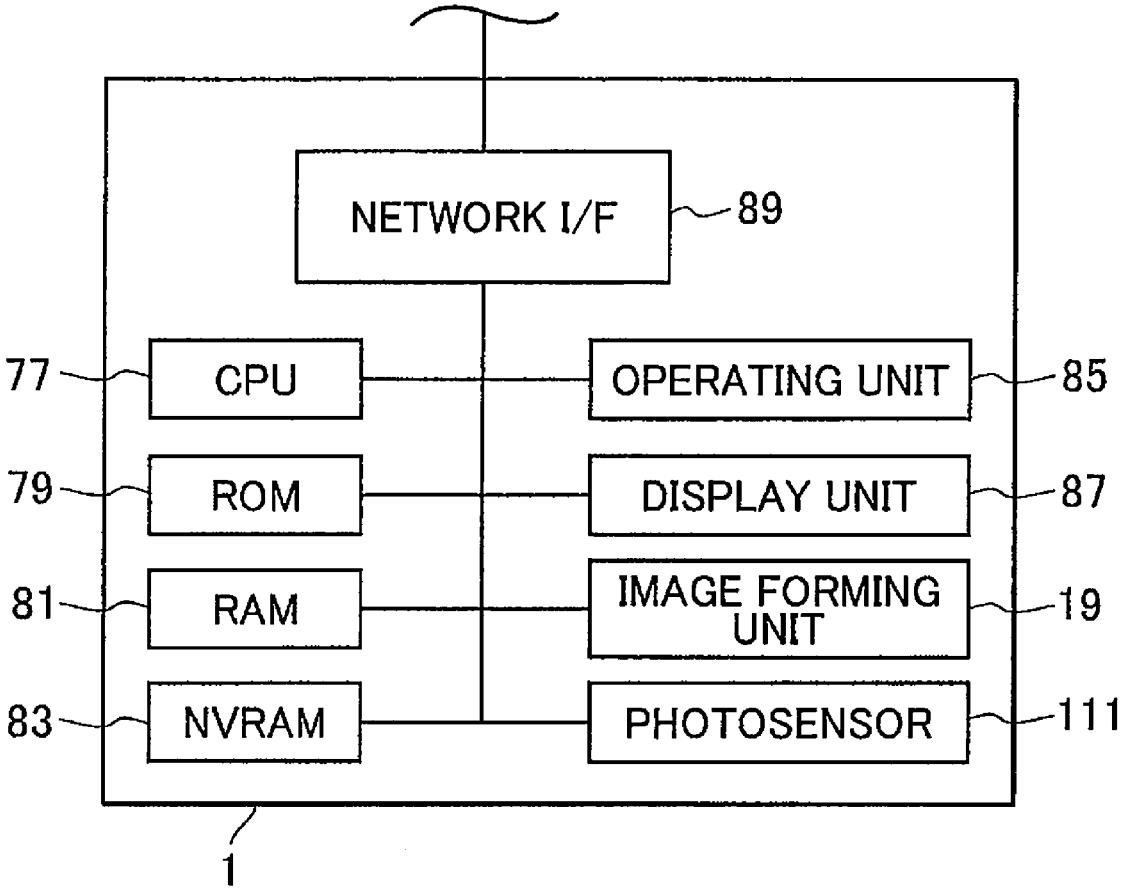
FIG. 2 is a block diagram showing the electrical structure of the printer.

FIG. 2 is a block diagram showing the electrical structure of the printer 1. The printer 1 includes a CPU 77, a ROM 79, a RAM 81, an NVRAM (nonvolatile memory) 83, an operating unit 85, a display unit 87, the image-forming unit 19 described above, a network interface 89, and photosensors 111.

The ROM 79 stores various programs for controlling operations of the printer 1. The CPU 77 controls operations of the printer 1 based on the programs read from the ROM 79 while storing processing results in the RAM 81 and NVRAM 83.

The operating unit 85 includes a plurality of buttons that the user can operate to input various instructions, such as a command to initiate printing. The display unit 87 is configured of a liquid crystal display and lamps for displaying various setup menus, operating states, and the like. The network interface 89 connects the printer 1 to an external computer (not shown) via a communication line 71, enabling data communications between the printer 1 and the external computer.

<Position Calibrating Process>

It is important to align the formation positions (transfer positions) of the color images in the tandem printer 1, because the color image will not be properly registered if the formation positions relative to the recording medium 7 deviate. Hence, a position calibrating process is performed to correct deviations in positions of the color images.

In the position calibrating process, the CPU 77 of the printer 1 reads data for a registration pattern 121A from the NVRAM 83, for example, and provides this data to the image-forming unit 19 as image data. The image-forming unit 19 forms the registration pattern 121A on the surface of the endless belt 31. The registration pattern 121A includes a plurality of marks 119 for each of the four colors, as will be described later, that are juxtaposed in the conveying direction of the endless belt 31 (front-to-rear direction of the printer 1).

IF the laser scanning positions are deviated from regular positions, the plurality of the marks 119 is not formed in positions ordered by the CPU 77. Therefore, the CPU 77 detects the positions of the marks 119 with the photosensors 111 described below, measures the amounts of deviation based on the detection results, and calibrates the laser scanning positions in order to cancel these deviations. Here, the laser scanning positions are positions in a subscanning direction in which the scanning unit 23 irradiates laser beams for each color onto the respective photosensitive drums 37. The laser scanning positions are modified by changing the timing at which the scanning unit 23 emits each laser beam.

1. Photosensors

Figure 3:
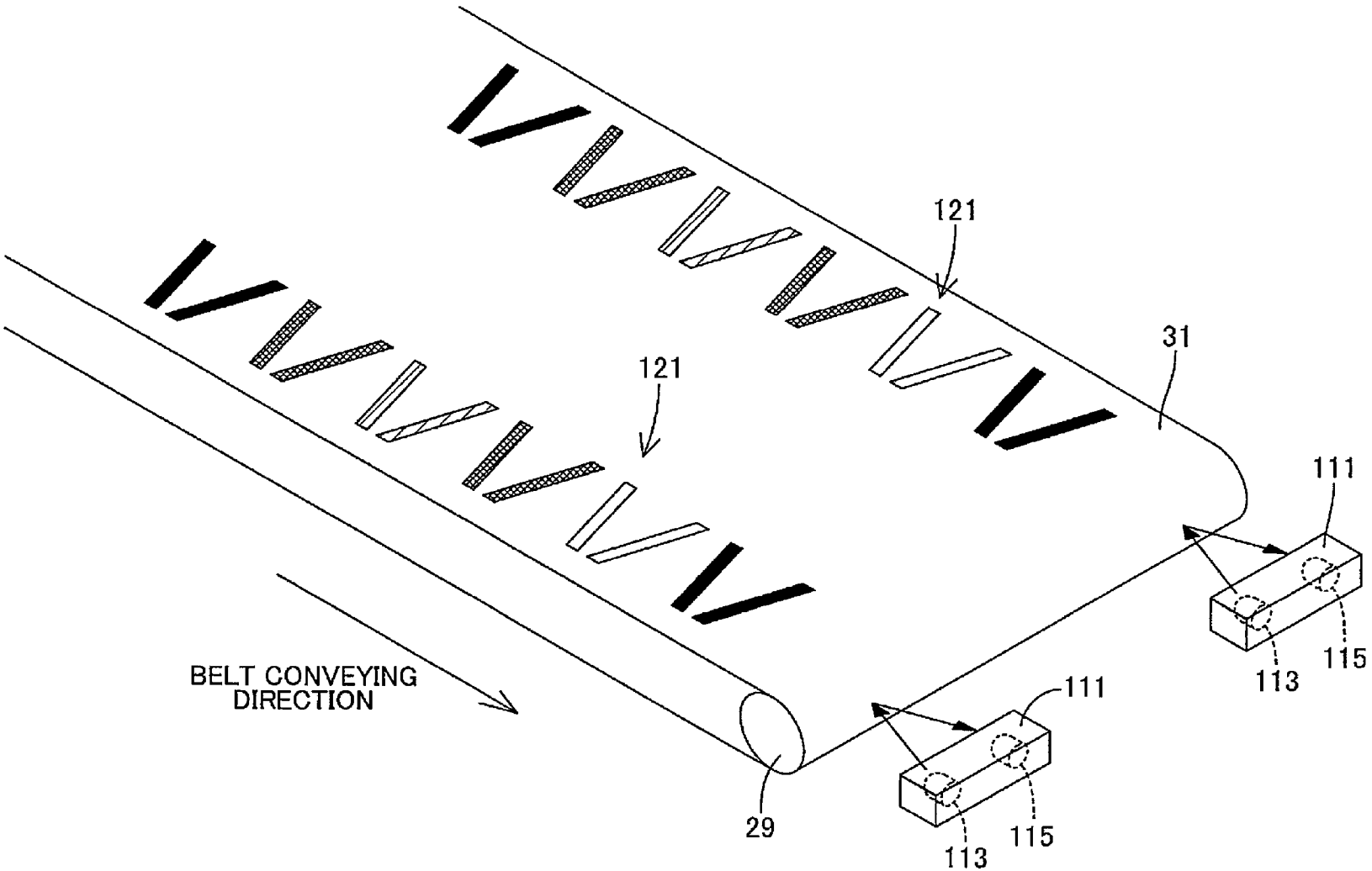
FIG. 3 is a perspective view of a photosensor and conveying belt.

As shown in FIG. 3, one or a plurality (two in the preferred embodiment) of the photosensors 111 is provided on the rear side of the endless belt 31 and juxtaposed in the left-to-right direction. Each of the photosensors 111 is a reflection sensor provided with a light-emitting element (such as an LED), and a light-receiving element (such as a phototransistor) 115. The light-emitting element 113 irradiates light obliquely onto the surface of the endless belt 31, and the light-receiving element 115 receives the light reflected off the surface of the endless belt 31. The regions in which the light emitted from the light-emitting elements 113 forms spots on the endless belt 31 are the detection regions of the photosensors 111. The width of the marks 119 in the conveying direction of the endless belt 31 is narrower than the width of the detection region.

Figure 4:
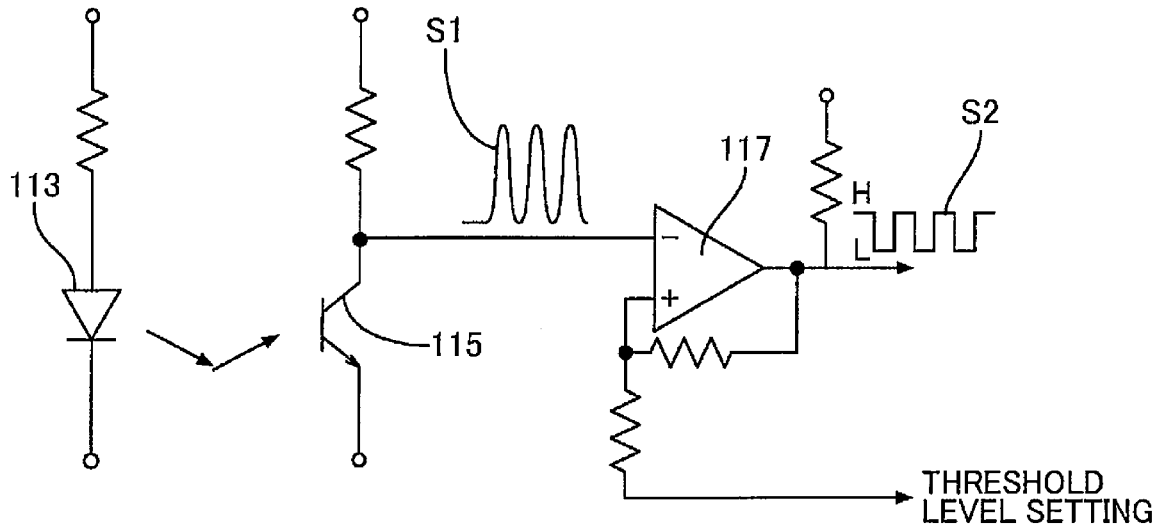
FIG. 4 is a circuit diagram of the photosensor.
Figure 5:
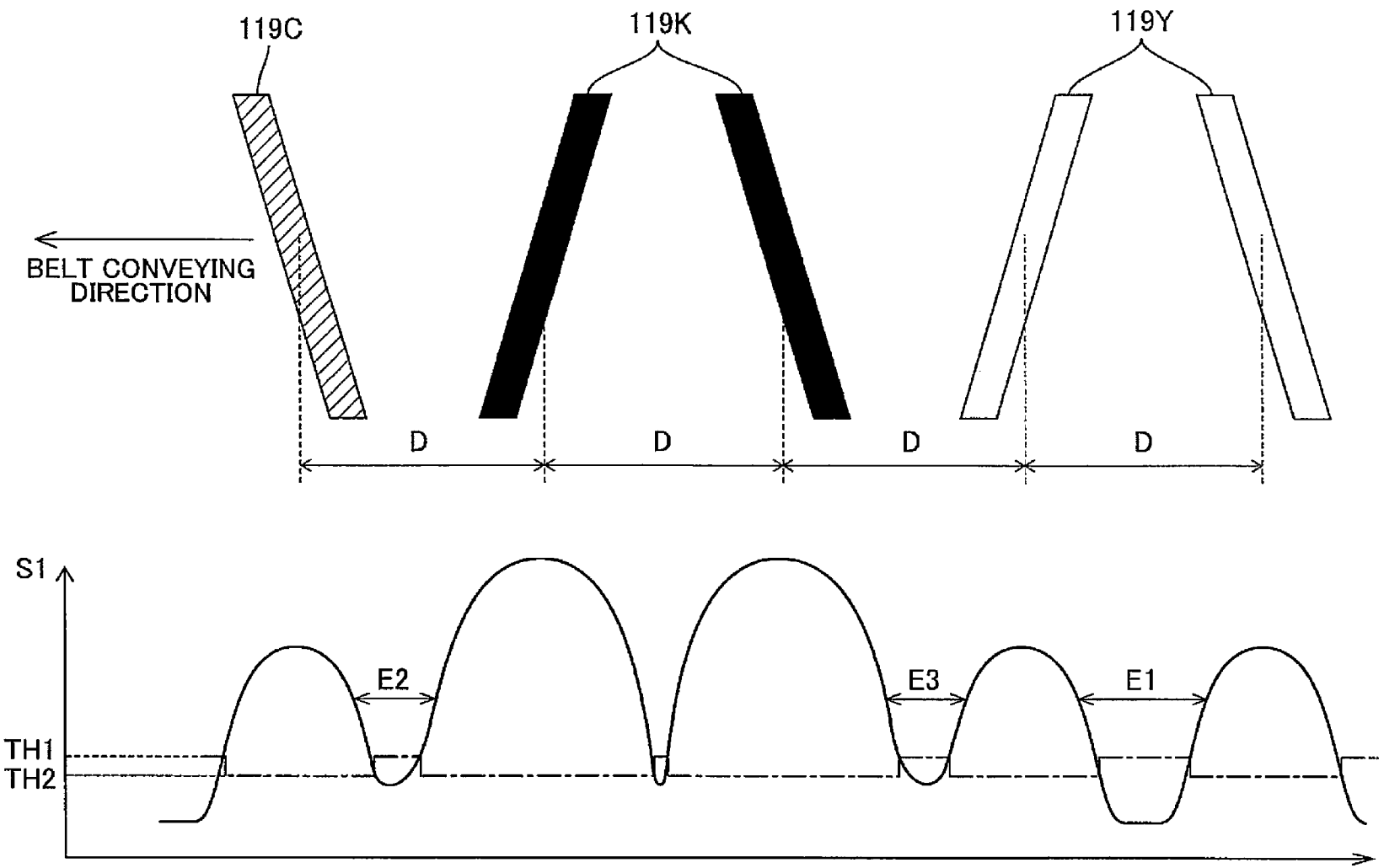
FIG. 5 is an explanatory diagram showing an example of a relationship between color patterns and the waveforms of light reception signals.

FIG. 4 is a circuit diagram of the photosensor 111. The light-receiving element 115 outputs a light reception signal S1 at a lower level the higher the level of received light, and a higher level the lower the level of received light. The S1 is inputted into a hysteresis comparator 117. The hysteresis comparator 117 compares the level of the light reception signal S1 to a threshold value (first and second threshold values TH1 and TH2 as shown in FIG. 5) and outputs a binary signal S2 having a level inverted based on the results of comparison.

2. Problems associated with differences in the reflectance characteristics of acromatic and chromatic marks FIG. 5 shows the marks 119 of each color in the upper part of the drawing and the waveform of the light reception signal S1 when each mark 119 enters the detection region in the lower part of the drawing in the conventional technique. In FIG. 5, the conveying direction of the endless belt 31 is toward the left.

Figure 7:
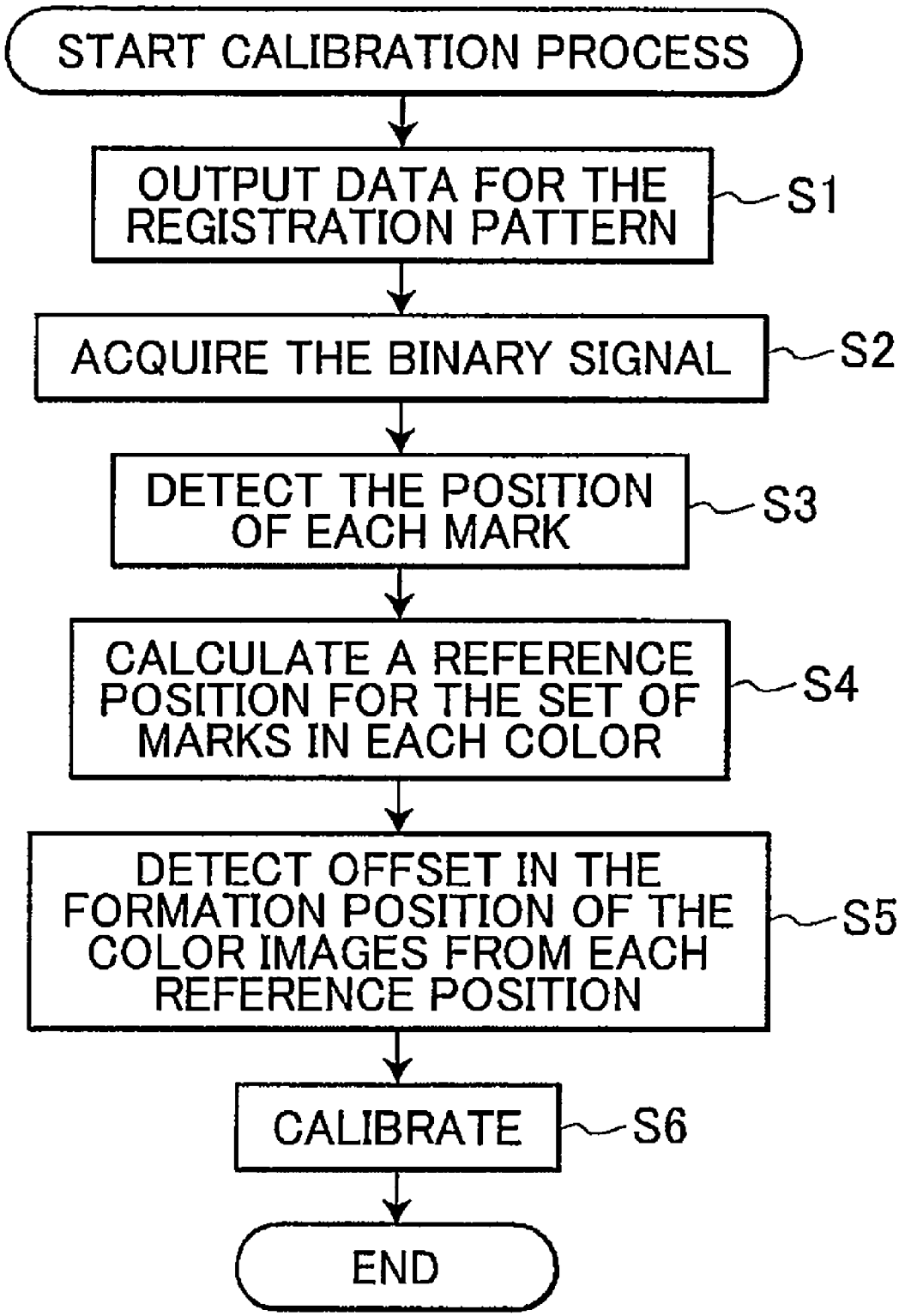
FIG. 7 is a flowchart showing the position calibrating process.

The endless belt 31 in the preferred embodiment is formed of a material including polycarbonate, for example, and has a higher reflectance than toner of any of the four colors. Hence, the light reception signal S1 level is lowest when light irradiated from the light-emitting element 113 onto the background of the endless belt 31 (the surface of the endless belt 31 in which no mark is formed), as shown in FIGS. 5 and 7. On the other hand, when the light-emitting element 113 irradiates light onto the marks 119 formed on the endless belt 31, the light-receiving element 115 receives a lower level of light, resulting in a higher light reception signal S1 level.

Of the four colors used in the printer 1 of the preferred embodiment, cyan, magenta, and yellow are chromatic, while black is achromatic. Therefore, the reflectance of the black mark 119K is lower than the reflectances of the chromatic marks 119C, 119M, and 119Y. More specifically, the reflectance of the black mark 119K differs greatly from the reflectance of the endless belt 31, while the reflectances of the chromatic marks 119C, 119M, and 119Y differ slightly from the reflectance of the endless belt 31. A difference between the reflectance of the black mark 119K and any of the reflectances of the chromatic marks 119C, 119M, and 119Y is larger than a difference between the reflectances of any two of the chromatic marks 119C, 119M, and 119Y.

Therefore, under the condition that the marks are all the same shape, size and dot density (number of dots per unit area), the waveform of the light reception signal S1 produced by reflected light from the black mark 119K (hereinafter simplified to "the light reception signal S1 for the black mark 119K") is broader along the time axis and has a higher peak than waveforms of the light reception signal S1 produced by the reflected light from the chromatic marks 119C, 119M, and 119Y (hereinafter simplified to "the light reception signal S1 for the chromatic marks 119C, 119M, and 119Y"), as shown in FIG. 5. Specifically, the light reception signal S1 for the black mark 119K depicts a waveform with a peak value and time width about 1.5 times those of the light reception signal S1 for the chromatic marks 119C, 119M, and 119Y.

FIG. 5 shows the conventional pattern in which the marks 119 of all colors are spaced at a uniform distance D. It is assumed that the distance between the black mark 119K and the marks positioned just before and just after the black mark 119K (the cyan mark 119C and the yellow mark 119Y in FIG. 5) is narrow, and the black mark 119K and the chromatic marks 119C, 119M, and 119Y are detected using common photosensors 111. In such a case, distances E2 and E3 between waveforms of the light reception signal S1 for the black mark 119K and the marks directly before and after the black mark 119K (the cyan mark 119C and yellow mark 119Y) are narrower than a distance E1 between waveforms of the light reception signal S1 for the yellow mark 119Y, as shown in FIG. 5. As a result, the waveforms of the light reception signal S1 can interfere with each other, making it impossible to detect each mark with accuracy. The CPU 77 calculates an intermediate position (intermediate timing) between the falling edge and rising edge of the binary signal S2, for example, and sets this intermediate position as the position of the respective mark 119.

3. Registration Pattern According to the Preferred Embodiment

Figure 6:
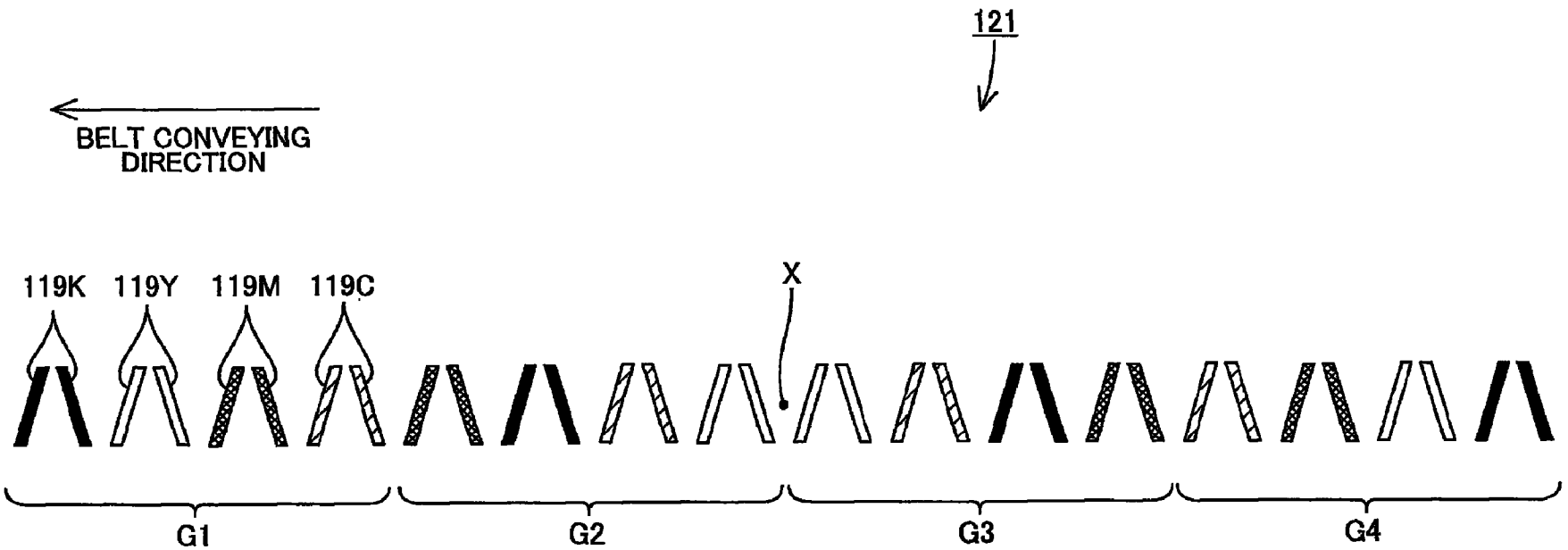
FIG. 6 is an explanatory diagram showing a registration pattern according to the first embodiment.

FIG. 6 shows the overall registration pattern 121 of the preferred embodiment. The registration pattern 121 is used to detect the amount of deviation in color registration in the subscanning direction (the conveying direction of the endless belt 31) and the main scanning direction (a direction orthogonal to the conveying direction of the endless belt 31). The registration pattern 121 in FIG. 6 shows a normal example in which no registration error occurs in either the subscanning direction or the main scanning direction.

The registration pattern 121 includes a plurality of groups G (four groups in the preferred embodiment), each group G including one each of a black mark 119K, yellow mark 119Y, magenta mark 119M, and cyan mark 119C. Each mark 119 is configured of a pair of bar-shaped marks, and each mark in the pair is oriented at a prescribed angle to a straight line following the main scanning direction and is symmetrical to the other mark in the pair about the same straight line.

The marks 119 are spaced at equal intervals. The four groups of marks 119 in the registration pattern 121 will be called group G1, group G2, group G3, and group G4 in order beginning from the leading group in the conveying direction of the endless belt 31. The order of the marks arranged in each of the groups G1-G4 is as follows.

Group G1: black mark 119K, yellow mark 119Y, magenta mark 119M, cyan mark 119C Group G2: magenta mark 119M, black mark 119K, cyan mark 119C, yellow mark 119Y Group G3: yellow mark 119Y, cyan mark 119C, black mark 119K, magenta mark 119M Group G4: cyan mark 119C, magenta mark 119M, yellow mark 119Y, black mark 119K Hence, in a normal registration state, the marks 119 are set such that a total of deviations of the marks 119 having one color from a reference position in the conveying direction is equal to a total of deviations of the marks 119 having another color from the reference position in the conveying direction. In the preferred embodiment, the total of deviations is zero, and a center point X between the neighboring yellow marks 119Y in FIG. 6 corresponds to the reference position. The marks 119 having a same color are arranged with a symmetrical relationship about the center point X with respect to the conveying direction. That is, the reference position is a center of gravity about which the marks 119 having a same color is positionally balanced in the conveying direction.

4. Position Calibrating Process

If the printer 1 is operating normally when the CPU 77 provides data for the registration pattern 121 described above to the image-forming unit 19, the image-forming unit 19 forms a pattern on the endless belt 31 so that the center point X corresponds to the reference position.

However, in an abnormal state in which the formation position of a color image is shifted from the normal formation position, the reference position of the marks corresponding to the shifted color image is offset from the center point X. When, for example, it is assumed that the black is a reference color, the amount of offset in the formation position of the shifted color image relative to the formation position of the black image is directly manifested as the amount of offset in the reference position of the set of marks for the other color relative to the reference position of the set of black marks.

Therefore, the CPU 77 can detect the offset in the formation position of each color image relatively easily through the process shown in FIG. 7. In S1 of the process in FIG. 7, the CPU 77 provides data for the registration pattern 121 to the image-forming unit 19. In S2 the CPU 77 acquires the binary signal S2 from the photosensor 111. In S3 the CPU 77 detects the position of the pair of bar-shaped marks constituting each mark 119 based on the binary signal S2 and sets the position of each mark 119 to the center position between its bar-shaped marks.

In S4 the CPU 77 calculates the reference position of each of the black marks 119K, the yellow marks 119Y, the magenta marks 119M, and the cyan marks 119C. In S5 the CPU 77 detects the offset of the reference position of the yellow marks 119Y, the magenta marks 119M, and the cyan marks 119C relative to the reference position of the black marks 119K offset in the subscanning direction. The offset of the reference position is the formation position of the images without change. In S6 the CPU 77 corrects color registration in the subscanning direction by adjusting the timing at which the scanning unit 23 emits laser beams corresponding to each color based on the amount of offset in the subscanning direction.

The CPU 77 detects the distance between the two bar-shaped marks of each mark 119 and computes an average distance between bar-shaped marks for each of the black marks 119K, yellow marks 119Y, magenta marks 119M, and cyan marks 119C. The average value for marks of each color is considered to be the amount of positional offset in the main scanning direction. Next, the CPU 77 calibrates color registration in the main scanning direction by adjusting the timing at which the scanning unit 23 emits laser beams for each color based on positional offset in the main scanning direction.

Effects of the Preferred Embodiment

In the conventional registration pattern, the reference position of the marks having one color is different from the reference position of the marks having another color in the normal state. Accordingly, it is necessary to set predetermined values indicating the difference between the reference positions for each color. Therefore, it is necessary to consider both the reference positions and the predetermined value in order to detect the amount of offset in the formation positions.

However, the registration pattern 121 according to the preferred embodiment sets the reference positions of the black marks 119K, yellow marks 119Y, magenta marks 119M, and cyan marks 119C to be all the same. Hence, the amount of offset in the formation positions of a same color image is directly manifested as the amount of offset in the reference position. Consequently, the CPU 77 can detect offset in the formation positions of the same color image without using predetermined values described in the conventional structure, thereby eliminating the effects of error introduced when setting the predetermined values and improving the accuracy for detecting offset in the formation positions of each image.

Further, the registration pattern 121 is configured so that in a normal state the marks having a same color is symmetrical about the center point X on the registration pattern 121 in the conveying direction of the endless belt 31 (the center position between the two adjacent yellow marks 119Y in FIG. 6). In this way, it is relatively easy to align the reference positions of the marks having a same color when generating data for the registration pattern 121.

Further, the number of the marks 119 having one chromatic color adjacent to the black (achromatic) mark 119K is equal to the number of the marks having another chromatic color adjacent to the black (achromatic) mark 119K. Specifically, two each of the yellow marks 119Y, magenta marks 119M and cyan marks 119C are positioned adjacent to the black marks 119K. In other words, interference by the reception light waveform of an adjacent black mark 119K affects all chromatic mark sets equally, preventing the effects of such interference from being concentrated on only one set of chromatic marks.

Further, the registration pattern 121 is configured of four groups G1-G4, the number of groups being an integer multiple (1 in the preferred embodiment) of the number of colors of toner used in the printer 1 (four colors in the preferred embodiment). Each of the four groups G1-G4 has one each of the marks 119 in each color. The order in which the black mark 119K, yellow mark 119Y, magenta mark 119M, and cyan mark 119C are arranged differs for each group G1-G4. The reflectance of the yellow mark 119Y, magenta mark 119M, and cyan mark 119C that are chromatic are delicately different from one another. Therefore, if the combination of the adjacent marks is consistently same, the effects of such interference by the reception light waveform of adjacent mark is concentrated on only one set of chromatic marks. However, in the preferred embodiments, one chromatic mark having one color is adjacent to the others chromatic marks having the other colors evenly, making detection of offset for the formation positions more accurate than when the combination of the adjacent marks is consistently same.

Second Embodiment

Figure 8:
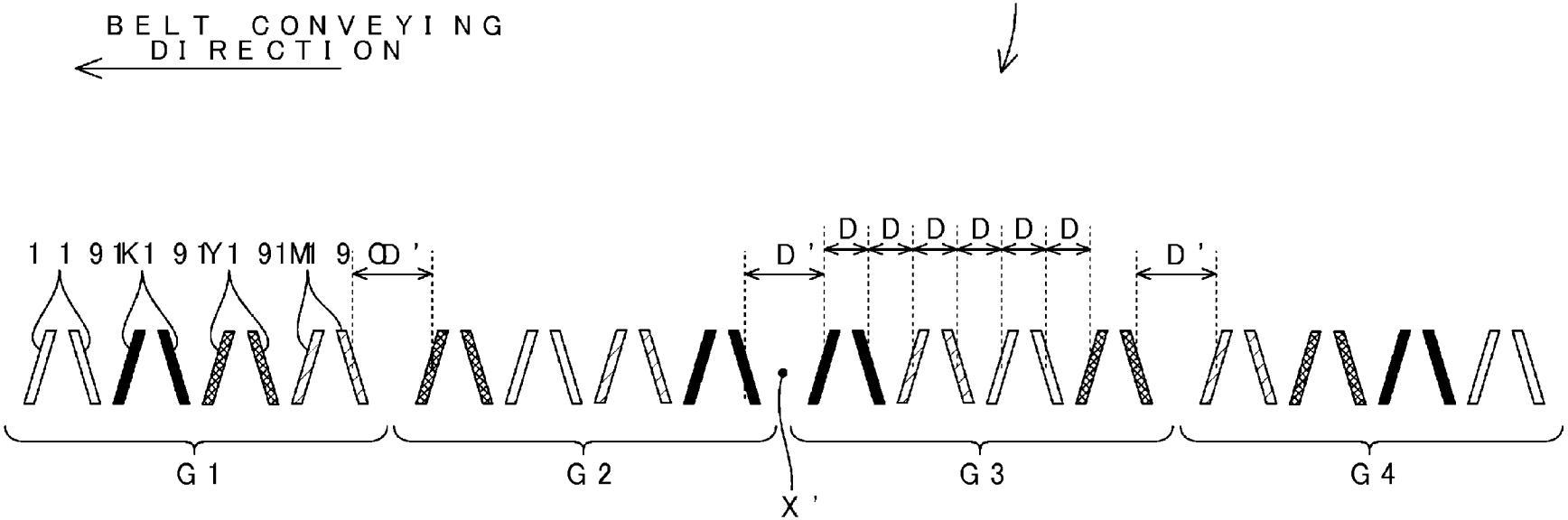
FIG. 8 is an explanatory diagram showing a registration pattern according to a second embodiment.

FIG. 8 shows a registration pattern according to a second embodiment of the present invention. Except for the structure of the registration pattern, the second embodiment is identical to the first embodiment described above. Hence, only differences in the second embodiment will be described below, and like parts and components are designated with the same reference numerals to avoid duplicating description.

As shown in FIG. 8, a registration pattern 125 according to the second embodiment has a plurality of marks 119 divided among groups G1, G2, G3, and G4 in order beginning from the leading position in the conveying direction of the endless belt 31.

The marks in the groups G1-G4 are arranged as follows.

Group G1: yellow mark 119Y, black mark 119K, magenta mark 119M, cyan mark 119C Group G2: magenta mark 119M, yellow mark 119Y, cyan mark 119C, black mark 119K Group G3: black mark 119K, cyan mark 119C, yellow mark 119Y, magenta mark 119M Group G4: cyan mark 119C, magenta mark 119M, black mark 119K, yellow mark 119Y With this arrangement, the reference positions for each color marks are aligned at the single center point X' of the registration pattern 125. However, in this registration pattern 125, two of the black marks 119K are adjacent to each other, at which point the effects of interference by the reference light waveforms are particularly high. Therefore, neighboring groups G are separated by a distance D' greater than the distance D between neighboring marks 119 in the same group.

Third Embodiment

Figure 9:
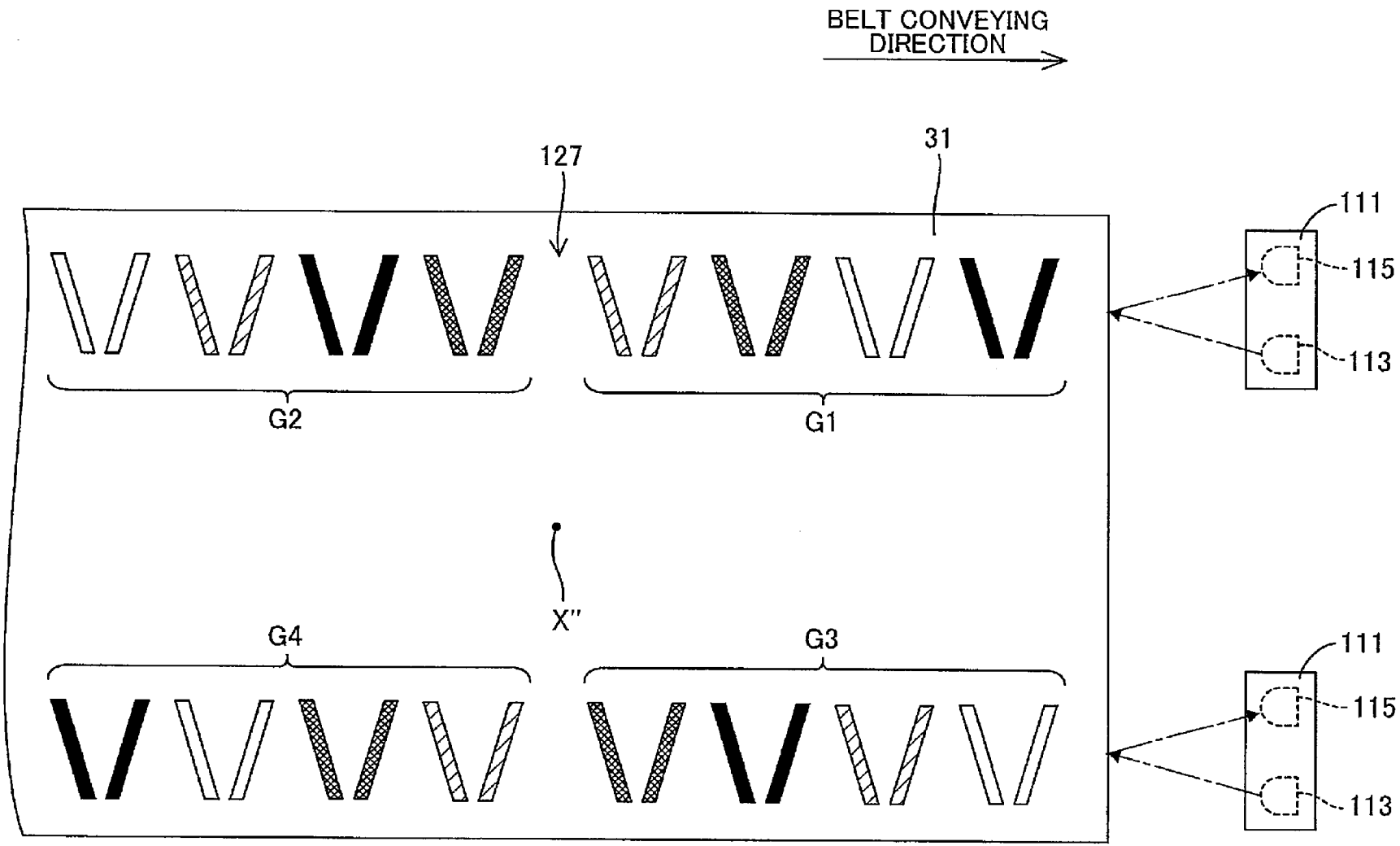
FIG. 9 is an explanatory diagram showing a registration pattern according to a third embodiment.

FIG. 9 shows a registration pattern according to a third embodiment of the present invention. Except for the registration pattern, the third embodiment is identical to the first embodiment described above. Therefore, only this difference will be described below, and like parts and components are designated with the same reference numerals to avoid duplicating description.

In a registration pattern 127 according to the third embodiment, the groups G1-G4 of the registration pattern 121 shown in FIG. 6 of the first embodiment are arranged in two rows juxtaposed in the width direction of the endless belt 31. Specifically, the registration pattern 127 includes groups G1 and G2 of the registration pattern 121 on the left side of the endless belt 31, and groups G3 and G4 on the right side. With this configuration, reference positions for each color are aligned at a single center point X" in the center of the registration pattern 127.

In the third embodiment, the printer 1 is provided with two photosensors 111. Further, with this registration pattern 127, a larger number of marks 119 can be arranged on the endless belt 31, thereby increasing the precision for detecting positional offset.

Fourth Embodiment

Figure 10:
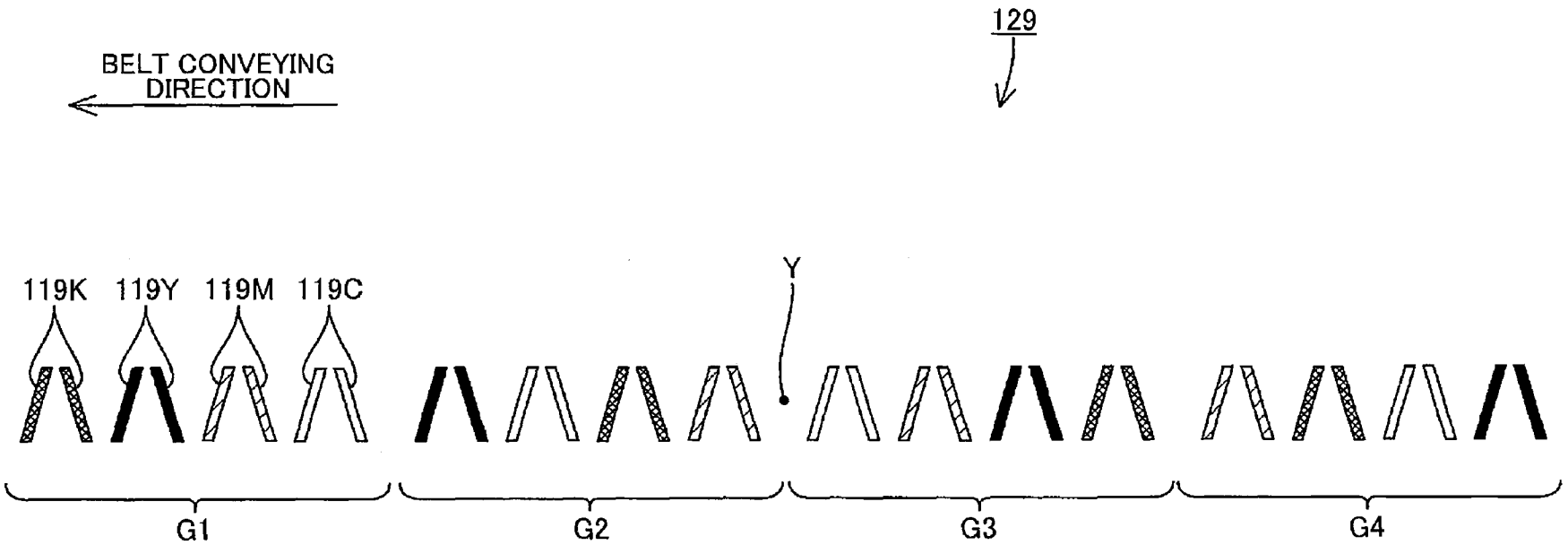
FIG. 10 is an explanatory diagram showing a registration pattern according to a fourth embodiment.

FIG. 10 shows a registration pattern according to a fourth embodiment of the present invention. Except for the structure of the registration pattern, the fourth embodiment is identical to the first embodiment described above. Therefore, only the differences of the fourth embodiment will be described below, and like parts and components are designated with the same reference numerals to avoid duplicating description.

There are numerous registration patterns other than those described above in the preferred embodiments for aligning the reference positions of sets of marks in all colors. For example, the marks having a same color are arranged with a symmetrical relationship about the reference position. A registration pattern 129 shown in FIG. 10 is one example. The registration pattern 129 has a plurality of the marks 119 divided among the groups G1, G2, G3, and G4 arranged in order from the leading position in the conveying direction of the endless belt 31.

The marks in the groups G1-G4 are arranged as follows.

Group G1: magenta mark 119M, black mark 119K, cyan mark 119C, yellow mark 119Y Group G2: black mark 119K, yellow mark 119Y, magenta mark 119M, cyan mark 119C Group G3: yellow mark 119Y, cyan mark 119C, black mark 119K, magenta mark 119M Group G4: cyan mark 119C, magenta mark 119M, yellow mark 119Y, black mark 119K With this arrangement, the reference positions for each color are aligned at a single center point Y in the overall registration pattern 129.

Variations of the Embodiments

While the invention has been described in detail with reference to specific embodiments thereof, it would be apparent to those skilled in the art that many modifications and variations may be made therein without departing from the spirit of the invention, the scope of which is defined by the attached claims.

(1) In the preferred embodiments described above, the reference positions are set to a point at which the total of deviation of the marks having a same color is zero, but it is not necessary for the prescribed value to be zero. However, since the reference positions are centrally located among the marks having a same color when the prescribed value is zero, this configuration simplifies the process for creating the registration pattern.

(2) With the registration patterns according to the preferred embodiments described above, the distance between the black mark 119K and a neighboring mark 119 may be set greater than the distance between neighboring chromatic marks in order to prevent interference between reception light waveforms.

(3) It is possible to calculate the reference positions separately for one bars extending in one direction of the bar-shaped marks and the other bars extending in another direction of the bar-shaped marks. When only one bars are arrayed in the conveying direction, it is possible to reduce the spacing of adjacent marks 119 more since all of one bars are parallel one another. Thus, it is easy to shorten the overall length of the registration pattern.

(4) In the preferred embodiment described above, the "target" on which patterns are formed is the endless belt 31 used for conveying the recording medium, but the target may be the recording medium 7 conveyed by the endless belt 31, such as a sheet of paper or transparency. Further, when the image-forming device employs an intermediate transfer system, the target may be the intermediate transfer belt functioning to directly carry developed images transferred from the image-carrying member.

(5) While the image-forming device in the preferred embodiment is a direct transfer-type color laser printer, the present invention may be applied to a laser printer with an intermediate transfer system or an inkjet printer. Further, the printer may employ two, three, or five or more colors.

What is claimed is:

1. An image-forming device comprising:

a pattern data generating unit configured to generate pattern data indicative of a pattern of a plurality of marks including a plurality of first marks each having a first color and a plurality of second marks each having a second color, such that:

the plurality of first marks being located such that a sum of vector distances from each of the first marks to a first reference position in a predetermined direction defines a first value, the plurality of second marks being located such that a sum of vector distances from each of the second marks to the first reference position in the predetermined direction defines a second value, and the first value is equal to the second value;

an image-forming unit configured to form color images on an object based on the pattern data;

a detecting unit configured to detect actual positions of the plurality of first marks formed on the object and to detect actual positions of the plurality of second marks formed on the object;

a calculating unit configured to calculate:

a sum of the vector distances from the actual positions of the first marks to the reference position, a sum of the vector distances from the actual positions of the second marks to the reference position, and an offset between the sum of the vector distances of the actual positions of the first marks and the sum of vector distances of the actual positions of the second marks; and a controlling unit configured to control the image-forming unit to calibrate the locations of the second marks as output from the pattern data generating unit based on the offset.

2. The image-forming device according to claim 1, wherein the first value and the second value are zero.

3. The image-forming device according to claim 1, wherein the plurality of first marks is arrayed in symmetry about the reference position in the predetermined direction, and the plurality of second marks is arrayed in symmetry about the reference position in the predetermined direction.

4. The image-forming device according to claim 1, wherein the plurality of marks further comprise marks of a third color, wherein the first color is achromatic, and the second color and the third color are chromatic, and wherein the detecting unit includes a light-receiving element configured to detect the positions of the plurality of marks formed on the object in the predetermined direction, based on changes in an amount of light reflected by the object.

5. The image-forming device according to claim 4, wherein at least two of the first marks are adjacent to one another at a first distance, and at least one of the first mark is adjacent to one of the second mark at a second distance, the first distance being greater than the second distance.

6. The image-forming device according to claim 4, wherein a sum of vector distances from each of the third marks to a first reference position in a predetermined direction defines a third value, wherein the third value is equal to each of the first value and the second value, and wherein the plurality of first marks is adjacent to a first number of the second marks and a second number of the third marks, the first number being equal to the second number.

7. The image-forming device according to claim 6, wherein the plurality of marks are divided into a plurality of groups including a first group and a second group each including the first mark, the second mark, and the third mark, wherein the first mark, the second mark, and the third mark are arrayed in the predetermined direction in the first group in a first order and in the second group in a second order different from the first order.

8. The image-forming device according to claim 7, wherein the first mark in the first group being adjacent to the first mark in the second group at a third distance in the predetermined direction, the third distance being greater than a distance between any two adjacent marks in each group.

9. The image-forming device according to claim 7, wherein the number of the plurality of groups is an integer multiple of the number of a plurality of colors included in the plurality of marks.

10. The image-forming device according to claim 1, wherein the plurality of marks is arrayed in a plurality of rows juxtaposed in a direction orthogonal to the predetermined direction.

11. The image-forming device according to claim 1, wherein each mark includes a first portion oriented at a first angle with respect to the predetermined direction and a second portion oriented at a second angle with respect to the predetermined direction, the first angle being different from the second angle.

12. A calibration method comprising:

generating pattern data indicative of a pattern of a plurality of marks including a plurality of first marks each having a first color and a plurality of second marks each having a second color, such that:

the plurality of first marks are located such that a sum of vector distances from each of the first marks to a first reference position in a predetermined direction defines a first value, the plurality of second marks are located such that a sum of vector distances from each of the second marks to the first reference position in the predetermined direction defines a second value, and the first value is equal to the second value;

forming color images via an image forming unit on an object based on the pattern data;

detecting actual positions of the plurality of first marks formed on the object and detecting actual positions of the plurality of second marks formed on the object;

calculating in a processor:

a sum of the vector distances from the actual positions of the first marks to the reference position, a sum of the vector distances from the actual positions of the second marks to the reference position, and an offset between the sum of the vector distances of the actual positions of the first marks and the sum of vector distances of the actual positions of the second marks; and calibrating locations of the second marks as output from the pattern data generating unit based on the offset wherein the calibrated locations of the second marks are able to be applied to the image forming unit.

* * * * *